US008177349B2

(12) United States Patent
Fukui

(10) Patent No.: US 8,177,349 B2
(45) Date of Patent: May 15, 2012

(54) IMAGE FORMING APPARATUS AND METHOD

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 499 days.

(21) Appl. No.: 12/396,831

(22) Filed: Mar. 3, 2009

(65) Prior Publication Data

US 2009/0225143 A1 Sep. 10, 2009

(30) Foreign Application Priority Data

Mar. 4, 2008 (JP) ..... 2008-053533

(51) Int. Cl.
*B41J 2/01* (2006.01)

(52) U.S. Cl. ..... 347/102; 347/14; 347/17; 399/341

(58) Field of Classification Search ..... 347/5, 14, 347/17, 102; 399/341
See application file for complete search history.

(56) References Cited

U.S. PATENT DOCUMENTS

| | | | | |
|---|---|---|---|---|
| 6,535,712 | B2 * | 3/2003 | Richards | 399/341 |
| 6,661,993 | B2 * | 12/2003 | Bartscher et al. | 399/341 |
| 7,616,910 | B2 * | 11/2009 | Bessho | 399/49 |
| 7,794,074 | B2 | 9/2010 | Vosahlo et al. | |
| 8,011,299 | B2 | 9/2011 | Vosahlo | |
| 2005/0156964 | A1 | 7/2005 | Hoshino | |
| 2005/0169680 | A1 * | 8/2005 | Ng et al. | 399/341 |
| 2006/0198964 | A1 | 9/2006 | Kaiser | |
| 2006/0203019 | A1 | 9/2006 | Yamanobe | |
| 2006/0290760 | A1 * | 12/2006 | German et al. | 347/102 |
| 2007/0046719 | A1 | 3/2007 | Yamanobe et al. | |
| 2007/0188541 | A1 * | 8/2007 | Hoshino | 347/21 |

FOREIGN PATENT DOCUMENTS

| | | | |
|---|---|---|---|
| JP | 2005-199457 | A | 7/2005 |
| JP | 2005-231350 | A | 9/2005 |
| JP | 2005-531438 | A | 10/2005 |
| JP | 2006-15691 | A | 1/2006 |
| JP | 2006-239685 | A | 9/2006 |
| JP | 2006-248041 | A | 9/2006 |
| JP | 2007-55017 | A | 3/2007 |
| WO | 2004/002746 | A1 | 1/2004 |

OTHER PUBLICATIONS

Japanese Office Action dated Jan. 10, 2012, issued in corresponding Japanese patent application No. 2008-053533 (English translation is attached).

Japanese Office Action dated Mar. 26, 2012, issued in corresponding Japanese patent application No. 2008-053533 (English translation is attached).

* cited by examiner

*Primary Examiner* — Daniel Petkovsek

(74) *Attorney, Agent, or Firm* — Birch, Stewart, Kolasch & Birch, LLP

(57) ABSTRACT

The image forming apparatus includes: an image forming device which forms an image on a recording medium; a transparent UV ink droplet ejection device which ejects and deposits droplets of transparent UV ink onto the recording medium; a UV light irradiation device which irradiates UV light onto the transparent UV ink having been deposited on the recording medium; a gloss condition setting device which sets a gloss condition of the image; and a UV light irradiation control device which controls an irradiation timing of the UV light irradiated from the UV light irradiation device in accordance with the gloss condition.

13 Claims, 12 Drawing Sheets

$P_1' < P_2'$ $P_1 > P_2$

IMAGE FORMING APPARATUS AND METHOD

BACKGROUND OF THE INVENTION

1. Field of the Invention

The present invention relates to an image forming apparatus and an image forming method, and more particularly to technology for controlling the level of gloss of an image formed on a recording medium.

2. Description of the Related Art

Japanese Patent Application Publication No. 2006-239685 discloses a method of varnishing an image by an inkjet method, wherein droplets of varnish are deposited in a screen pattern in order to adjust and control the level of gloss. According to this method, an ultraviolet (UV) curable varnish having high fluidity is used if a highly glossy surface is to be formed, while another UV-curable varnish having low fluidity is used if a matte surface of low gloss is to be formed. In other words, it is necessary to switch between the use of different UV-curable varnishes having different wetting properties (fluidities), in order to obtain images having different gloss levels. Therefore, this method is not suitable for printing small numbers of prints, since there is an increase in the labor input, time and costs, and the like, required in switching the UV-curable varnishes, and hence there is a problem in that small numbers of prints cannot be made efficiently and quickly.

Japanese Patent Application Publication No. 2006-015691 discloses a method in which the surface of a medium on which an image (a picture and/or text characters) has been printed by means of an inkjet printer using UV-curable ink is coated with a clear coating layer made of a transparent or semi-transparent clear ink having as a main component a resin having a reflectivity that is the same or substantially the same within an error range of ±0.5 with respect to the resin forming the main component of the ink contained in a plurality of UV-curable ink dots composing the image. According to this method, the light reflected by the surface of the ink dots composing the image printed on the surface of the recording medium is not reflected randomly at the interfaces between the ink dots and the clear coating layer, but rather is reflected in substantially parallel directions upwards from the surface of the recording medium, and hence the gloss of the surface of the image coated with the clear coating surface is raised and the quality of the image is improved. In this method, however, no consideration is given to changing the gloss of the image and it is not possible to achieve images having different gloss levels.

SUMMARY OF THE INVENTION

The present invention has been contrived in view of these circumstances, an object thereof being to provide an image forming apparatus and image forming method whereby a small number of prints having different gloss levels can be made quickly and efficiently.

In order to attain the aforementioned object, the present invention is directed to an image forming apparatus, comprising: an image forming device which forms an image on a recording medium; a transparent UV ink droplet ejection device which ejects and deposits droplets of transparent UV ink onto the recording medium; a UV light irradiation device which irradiates UV light onto the transparent UV ink having been deposited on the recording medium; a gloss condition setting device which sets a gloss condition of the image; and a UV light irradiation control device which controls an irradiation timing of the UV light irradiated from the UV light irradiation device in accordance with the gloss condition.

According to this aspect of the present invention, it is possible to achieve images having different gloss levels by controlling the time period from the deposition of the droplets of the transparent UV ink until the irradiation of the UV light (the UV light irradiation timing), in accordance with the image gloss conditions (print conditions). Consequently, it is not necessary to use transparent UV inks having different wetting properties and therefore small numbers of prints having different gloss levels can be made rapidly and efficiently.

Preferably, the UV light irradiation device is capable of movement relative to the recording medium; and the UV light irradiation control device controls the irradiation timing of the UV light irradiated from the UV light irradiation device by controlling the movement of the UV light irradiation device.

Preferably, the UV light irradiation device includes a plurality of UV light sources; and the UV light irradiation control device controls the irradiation timing of the UV light irradiated from the UV light irradiation device by irradiating UV light selectively from the UV light sources.

Preferably, a first one of the UV light sources performs preliminary curing of the transparent UV ink having been deposited on the recording medium; and a second one of the UV light sources performs main curing of the transparent UV ink having been subjected to the preliminary curing.

Preferably, the UV light irradiation control device controls irradiation intensity of the UV light irradiated from the UV light irradiation device in accordance with the gloss condition.

Preferably, the UV light irradiation control device controls an irradiation region of the UV light irradiated from the UV light irradiation device in accordance with the gloss condition.

Preferably, the image forming apparatus further comprises a transparent UV ink droplet deposition control device which controls a deposition volume of the transparent UV ink onto the recording medium.

Preferably, the transparent UV ink droplet deposition control device controls the deposition volume of the transparent UV ink onto the recording medium, by controlling at least one of a number of droplet depositions, a droplet ejection volume, and a droplet deposition density, of the transparent UV ink droplet ejection device.

Preferably, the transparent UV ink droplet deposition control device controls the transparent UV ink droplet ejection device in such a manner that the droplets of the transparent UV ink are deposited onto the recording medium in a form of a staggered matrix.

Preferably, the transparent UV ink droplet deposition control device controls the transparent UV ink droplet ejection device in such a manner that a density of the deposited droplets of the transparent UV ink in a direction that is perpendicular to a conveyance direction of the recording medium is greater than a density of the deposited droplets of the transparent UV ink in the conveyance direction of the recording medium.

Preferably, the image forming apparatus further comprises: a gloss determination device which determines a degree of gloss on the recording medium, wherein control of the UV light irradiation control device is performed in accordance with the degree of gloss determined by the gloss determination device.

Preferably, the image forming apparatus further comprises: a gloss determination device which determines a degree of gloss on the recording medium, wherein control of the transparent UV ink droplet deposition control device is performed in accordance with the degree of gloss determined by the gloss determination device.

Preferably, the image forming device uses an inkjet method.

In order to attain the aforementioned object, the present invention is also directed to an image forming method, comprising the steps of: forming an image on a recording medium; ejecting and depositing droplets of transparent UV ink onto the recording medium; irradiating UV light onto the transparent UV ink deposited in the ejecting and depositing step; setting a gloss condition of the image; and controlling an irradiation timing of the UV light irradiated in the irradiating step in accordance with the gloss condition set in the setting step.

According to the present invention, it is possible to achieve images having different gloss levels by controlling the time period from the deposition of the droplets of the transparent UV ink until the irradiation of the UV light (the UV light irradiation timing), in accordance with the image gloss conditions (print conditions). Consequently, it is not necessary to use transparent UV inks having different wetting properties and therefore small numbers of prints having different gloss levels can be made rapidly and efficiently.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The present invention is able to achieve images having different gloss levels by changing the time until ultraviolet (UV) light is irradiated after the deposition of droplets of transparent UV ink onto the surface of a recording medium (i.e., UV light irradiating timing), and changing the irradiation intensity (exposure amount) of the UV light, in accordance with the gloss conditions (print conditions) of the image.

The overall sequence of the image forming method according to an embodiment of the present invention is described with reference to FIGS. 1A to 1D.

Figure 1A:
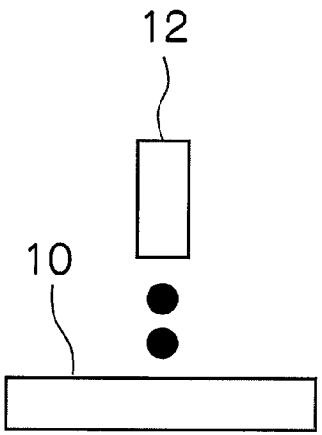
FIGS. 1A to 1D are illustrative diagrams showing the overall sequence of an image forming method according to an embodiment of the present invention.

Firstly, as shown in FIG. 1A, droplets of colored ink are ejected from nozzles (not shown) of an inkjet head (a colored ink head) 12 to form an image on the surface of a recording medium 10. The method for forming the image is not limited to the inkjet method, and it is also possible to employ another method.

Figure 1B:
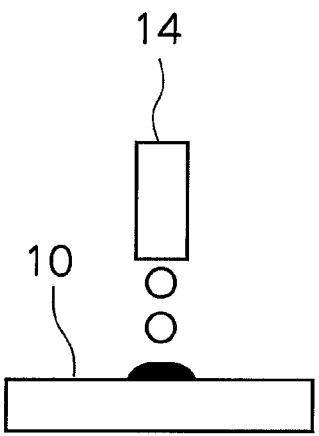

Then, as shown in FIG. 1B, droplets of transparent UV ink are ejected from nozzles of another inkjet head (a transparent UV ink head) 14, and the droplets of the transparent UV ink are thereby deposited on the surface of the recording medium 10 on which the image has been formed. In the present embodiment, the inkjet method is suitable as a method for depositing the droplets of the transparent UV ink, since it allows the droplets of the transparent UV ink to be deposited selectively onto the recording medium 10. The droplets of the transparent UV ink may be deposited onto not only the region (image region) where the droplets of the colored ink have been deposited but also the region where no droplets of the colored ink are deposited.

Figure 1C:
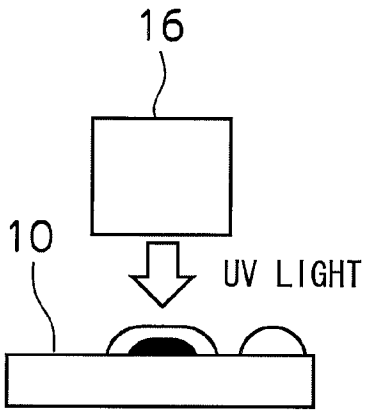
Figure 1D:
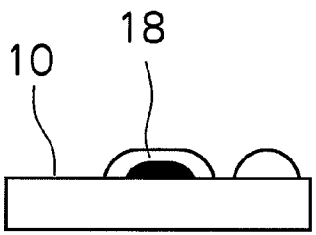

Next, as shown in FIG. 1C, UV light is irradiated onto the droplets of the transparent UV ink that have been deposited on the surface of the recording medium 10, using a UV light source (UV lamp) arranged in a UV light irradiation unit 16. When the UV light is irradiated, the transparent UV ink is cured and as shown in FIG. 1D, a transparent UV ink layer (varnish coating layer) 18 composed of the transparent UV ink is formed on the surface of the recording medium 10.

Figure 2:
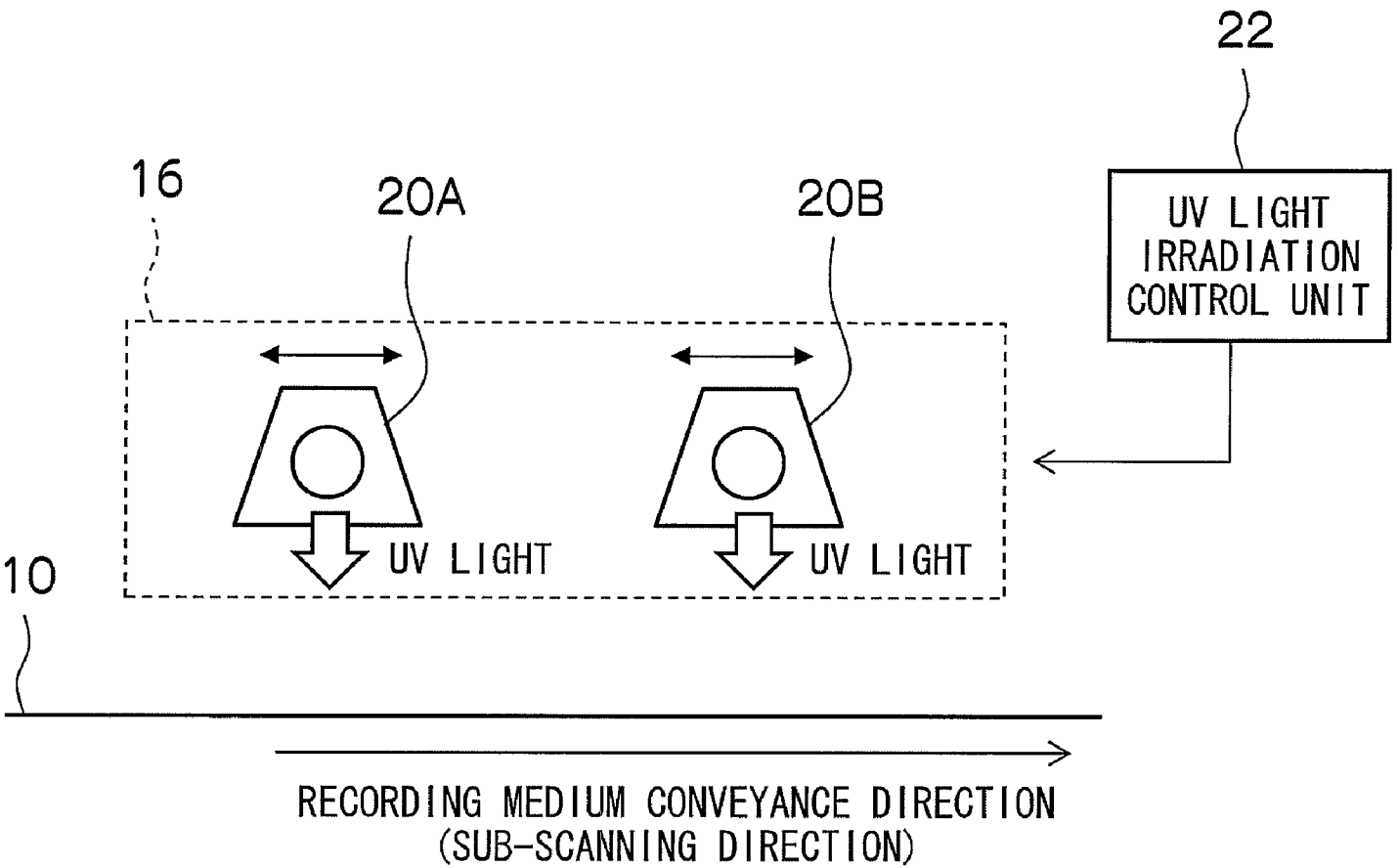
FIG. 2 is a diagram showing a composition of a UV light irradiation unit according to an embodiment of the present invention.
Figure 3A:
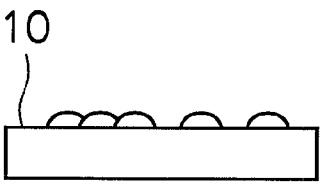
FIGS. 3A to 3D are illustrative diagrams of a case where a complete matte finish is formed.
Figure 3B:
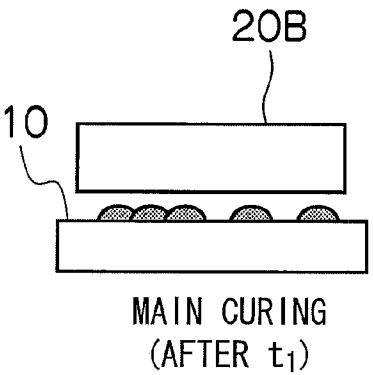
Figure 3C:
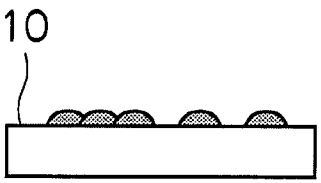
Figure 3D:
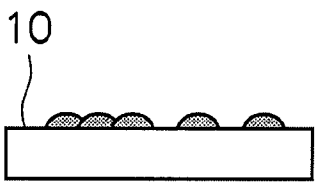
Figure 4A:
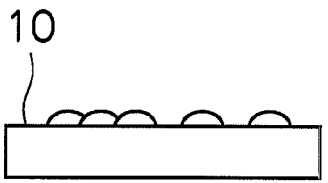
FIGS. 4A to 4D are illustrative diagrams of a case where a complete gloss finish is formed.
Figure 4B:
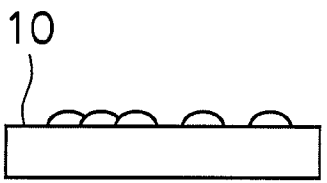
Figure 4C:
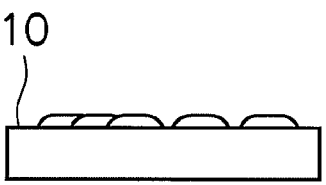
Figure 4D:
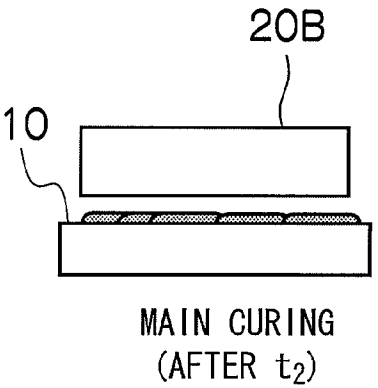
Figure 5A:
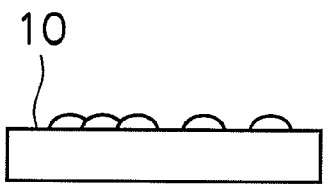
FIGS. 5A to 5D are illustrative diagrams of a case where a matte portion and a gloss portion are formed together.
Figure 5B:
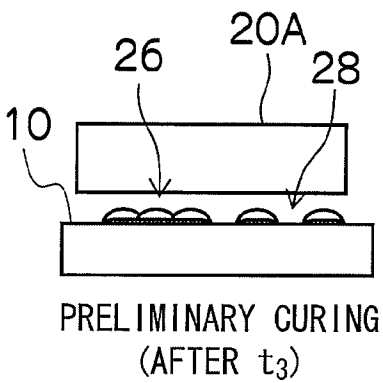
Figure 5C:
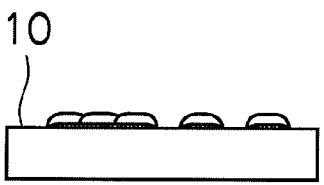
Figure 5D:
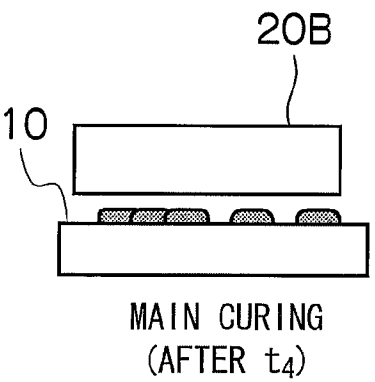

FIG. 2 is a schematic drawing showing the UV light irradiation unit 16 according to the present embodiment. As shown in FIG. 2, a plurality of UV light sources (UV lamps) 20A and 20B are arranged in the UV light irradiation unit 16. The UV light sources 20A and 20B are disposed in sequence following the direction of conveyance of the recording medium 10 (sub-scanning direction) and are configured in such a manner that each of the UV light sources 20A and 20B can be independently moved back and forth along the sub-scanning direction. The first UV light source 20A functions as a preliminary curing device for performing preliminary curing of the transparent UV ink, and the second UV light source 20B functions as a main curing device for performing main curing of the transparent UV ink.

Figure 11:
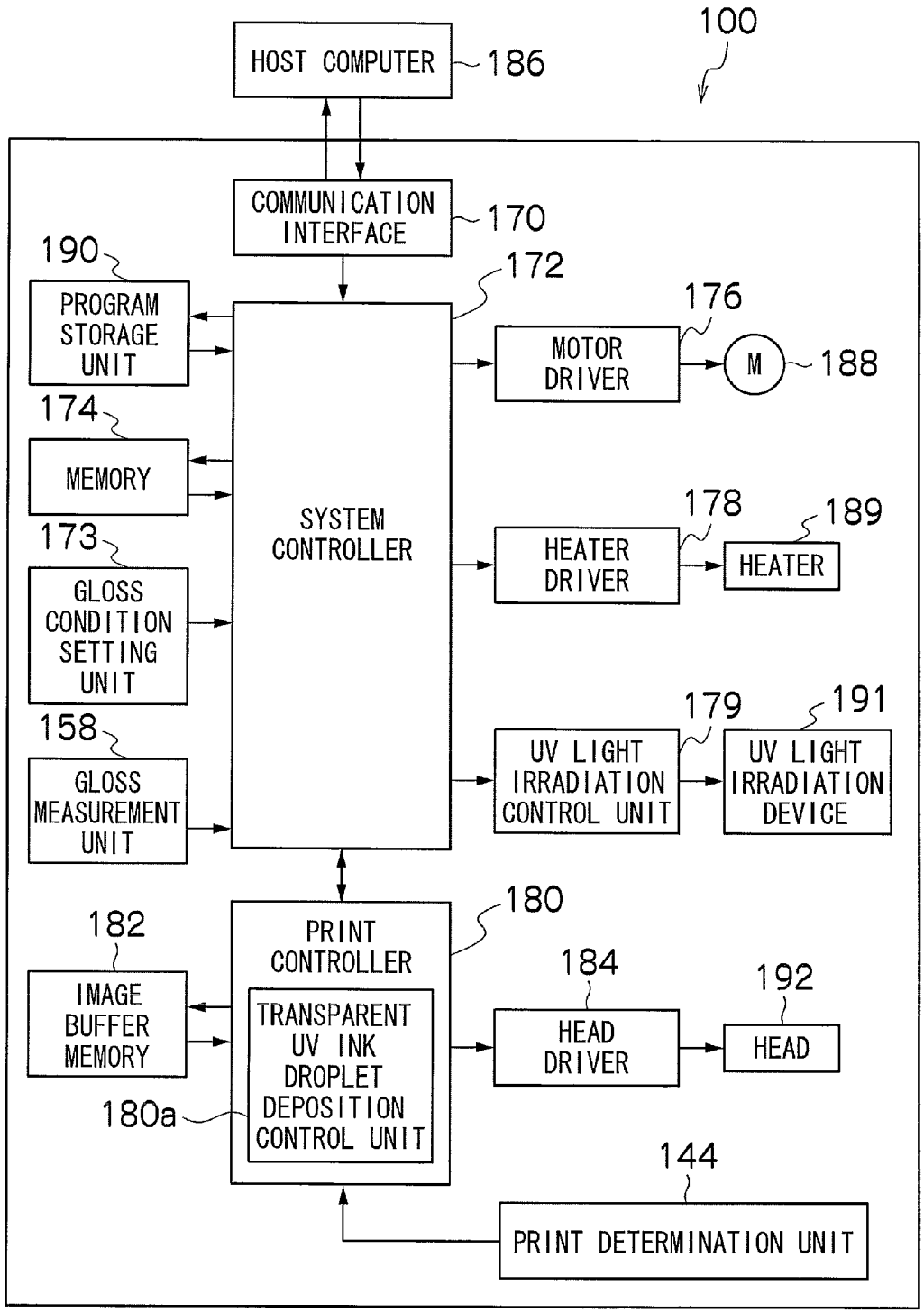
FIG. 11 is a principal block diagram showing a system configuration of the image forming apparatus shown in FIG. 8.

A UV light irradiation control unit 22 is a control unit that controls the timing of the irradiation of the UV light onto the transparent UV ink in accordance with the gloss conditions (print conditions) of the image, which are set by the gloss condition setting unit (see FIG. 11). In the present embodiment, the irradiation timing of the UV light is controlled by controlling the movement of the UV light sources 20A and 20B in the sub-scanning direction. Furthermore, the UV light irradiation control unit 22 controls the irradiation times, the irradiation intervals and the irradiation intensities, and the like, of the UV light sources 20A and 20B.

FIGS. 3A to 3D are diagrams for describing the control method in a case where a complete matte finish is to be obtained, FIGS. 4A to 4D are diagrams for describing the control method in a case where a complete gloss finish is to be obtained, and FIGS. 5A to 5D are diagrams for describing the control method in a case where a gloss finish portion and a matte finish portion are formed together. In order to simplify the description, in the drawings, it is assumed that an image has already been formed on the surface of the recording medium 10, and the ink dots that constitute the image are not shown.

As shown in FIGS. 3A to 3D, when a matte finish is to be obtained over the whole image, the UV light irradiation control unit 22 implements control in such a manner that UV light is irradiated onto droplets of the transparent UV ink from the second UV light source 20B, at $t_1$ seconds after depositing the droplets of the transparent UV ink onto the recording medium 10. The time period $t_1$ is approximately several tens to several hundreds of milliseconds, for example, and is set to an optimal value in accordance with the composition of the transparent UV ink and the material of the surface of the recording medium 10. By shortening the time period until the irradiation of the UV light in comparison with a case where a complete gloss finish is to be formed as described below, it is possible to perform main curing of the transparent UV ink on the recording medium 10 before the dots made of the transparent UV ink on the recording medium 10 wet and spread and become leveled. Thus, it is possible to form a matte surface over the whole of the image.

On the other hand, as shown in FIGS. 4A to 4D, when a gloss finish is to be obtained over the whole image, the UV light irradiation control unit 22 implements control in such a manner that UV light is irradiated onto droplets of the transparent UV ink from the second UV light source 20B, at $t_2$ ($>t_1$) seconds after depositing the droplets of the transparent UV ink onto the recording medium 10. The time period $t_2$ is approximately 0.5 to 2 seconds, for example, and is set to an optimal value in accordance with the composition of the transparent UV ink and the material of the surface of the recording medium 10. By lengthening the time period until the irradiation of the UV light in comparison with a case where a complete matte finish is to be formed as described above, it is possible to perform main curing of the transparent UV ink on the recording medium 10 after the dots made of the transparent UV ink have wet and spread on the recording medium 10, uniting with other dots and becoming leveled. Thus, it is possible to form a gloss surface over the whole of the image.

As shown in FIGS. 5A to 5D, when a combination of a gloss portion and a matte portion is to be formed over the image, the UV light irradiation control unit 22 implements control in such a manner that UV light is irradiated onto droplets of the transparent UV ink from the first UV light source 20A, at $t_3$ seconds after depositing the droplets of transparent UV ink onto the recording medium 10. Furthermore, the UV light irradiation control unit 22 implements control in such a manner that UV light is irradiated onto the droplets of the transparent UV ink from the second UV light source 20B, at $t_4$ ($>t_3$) seconds after the deposition of the droplets of the transparent UV ink onto the recording medium 10. For example, $t_3$ is approximately several tens to several hundreds of milliseconds, and $t_4$ is approximately 0.5 to 2 seconds. These values ($t_3$, $t_4$) are respectively set to optimal values in accordance with the composition of the transparent UV ink and the material of the surface of the recording medium 10. Furthermore, the irradiation intensity $E_1$ of the first UV light source 20A is set to be lower than the irradiation intensity $E_2$ of the second UV light source 20B.

By this means, firstly, by irradiating UV light from the first UV light source 20A in a preliminary curing (pinning) step, the droplets of the transparent UV ink deposited onto the recording medium 10 are caused to increase in viscosity at the interface with the recording medium 10, and therefore permeation of the transparent UV ink into the recording medium 10 is suppressed. In this case, in an overlapping dot region 26 where there is mutual overlapping between the dots created by the droplets of the transparent UV ink deposited on the recording medium 10, the surface portions of the respective dots do not increase in viscosity and therefore the dots unite with each other due to their surface tension and they proceed to become leveled. On the other hand, in an isolated dot region 28 where there is no mutual overlap between the dots of the transparent UV ink, as a result of the preliminary curing, there is an increase in the viscosity at the interface between the recording medium 10 and the transparent UV ink, and therefore the transparent UV ink does not wet and spread on the recording medium 10 and the isolated state of the dots is maintained. Consequently, by irradiating UV light from the second UV light source 20B in the main curing step, it is possible to perform main curing of the transparent UV ink on the recording medium 10. Thus, the overlapping dot region 26 on the recording medium 10 becomes a gloss portion (a region of high gloss), and the isolated dot region 28 becomes a matte portion (a region of low gloss).

A drying unit may also be added between the first UV source 20A and the second UV source 20B. For example, if a gloss portion and a matte portion are to be formed together, then after depositing droplets of the transparent UV ink onto the recording medium 10, the interface of the transparent UV ink with the recording medium 10 is raised in viscosity (cured preliminarily) by the first UV light source 20A, thereby suppressing the permeation of the transparent UV ink into the recording medium 10, and furthermore the solvent in the transparent UV ink can be removed by the drying unit. Moreover, it is also possible to carry out main curing of the transparent UV ink by the second UV light source 20B after the drying. This is desirable for cases where droplets of the transparent UV ink containing water or a volatile solvent are deposited on a recording medium having permeable properties.

It is also possible that the irradiation intensities of the UV light of the UV light sources 20A and 20B are adjustable. In this case, it is possible to make the first UV light source 20A serve both as a preliminary curing device and a main curing device. For example, in the case shown in FIGS. 3A to 3D (the case where the matte finish is formed over the whole image), it is possible to implement control in such a manner that UV light is irradiated onto the droplets of the transparent UV ink from the first UV light source 20A, instead of the second UV light source 20B, at $t_1$ seconds after depositing the droplets of the transparent UV ink onto the recording medium 10.

Furthermore, it is also possible to make very slight adjustments of the gloss level by adjusting the irradiation intensities of the UV light of the UV light sources 20A and 20B. For example, in the respective cases shown in FIGS. 3A to 5D, the wetting and spreading of the transparent UV ink is suppressed by controlling the irradiation intensity of the UV light to a higher level than a previously set specified value, and therefore it is possible to form a surface having a lower gloss level. On the other hand, by setting the irradiation intensity of the UV light to a lower value than the specified value, the transparent UV ink becomes more liable to wet and spread in comparison with a case where the irradiation intensity of the UV light is high, and therefore it is possible to form a surface having a high level of glossiness.

It is also possible to provide three or more UV light sources in the UV light irradiation unit 16. For example, it is possible to control the irradiation timing of the UV light by setting the UV light sources to a fixed state in the sub-scanning direction and irradiating UV light selectively from these UV light sources. In this case, a mechanism for moving the UV light sources becomes unnecessary and the composition of the apparatus can be simplified. More desirably, this is used in combination with a mode in which the irradiation intensities of the UV light sources can be adjusted as described above.

In the present embodiment, a desirable mode is one in which the amount of the transparent UV ink to be deposited onto the recording medium (the film thickness of the transparent UV ink) is controlled. The amount of the transparent UV ink to be deposited onto the recording medium (the film thickness of the transparent UV ink) can be controlled by altering the droplet deposition volume (ejection volume) of the transparent UV ink or the number of droplet depositions performed from the nozzles of the inkjet head (transparent UV ink head). By this means, it is possible to finely change the gloss levels of the image.

The following Tables 1 and 2 show examples of the relationship between the gloss level of the image and the deposition volume of the transparent UV ink.

TABLE 1

| Gloss level | Resolution in main scanning direction (dpi) | Resolution in sub-scanning direction (dpi) | Number of droplet depositions | Liquid droplet volume (pl) | Deposition volume (Film thickness of solid deposition (μm)) |
|---|---|---|---|---|---|
| Unvarnished finish | 1200 | 900 | 1 | 1.5 | 2.5 |
| Matte finish | 1200 | 900 | 2 | 3.0 | 5.0 |
| Gloss finish | 1200 | 900 | 3 | 4.5 | 7.5 |

TABLE 2

| Gloss level | Resolution in main scanning direction (dpi) | Resolution in sub-scanning direction (dpi) | Number of droplet depositions | Liquid droplet volume (pl) | Deposition volume (Film thickness of solid deposition (μm)) |
|---|---|---|---|---|---|
| Unvarnished finish | 600 | 600 | 1 | 3.5 | 2.0 |
| Varnished finish 1 | 600 | 600 | 2 | 7.0 | 3.9 |
| Varnished finish 2 | 600 | 600 | 3 | 10.5 | 5.9 |
| Varnished finish 3 | 600 | 600 | 4 | 14.0 | 7.8 |
| Varnished finish 4 | 600 | 600 | 5 | 17.5 | 9.8 |
| Varnished finish 5 | 600 | 600 | 6 | 21.0 | 11.7 |

In Tables 1 and 2, the "resolution in the main scanning direction" and the "resolution in the sub-scanning direction" represent the droplet deposition resolution (droplet deposition density) of the inkjet head that ejects droplets of the transparent UV ink. The "number of droplet depositions" represents the number of times that droplets of the transparent UV ink are ejected (number of droplets deposited) onto the same position on the recording medium, from the nozzles of the inkjet head. The "liquid droplet volume" is a volume obtained by multiplying the "number of droplet depositions" by the droplet ejection volume of the transparent UV ink (the ejection volume per ejection action of the inkjet head). The "deposition volume (film thickness of solid deposition)" represents the deposition volume (film thickness) of the transparent UV ink when droplets of the transparent UV ink are deposited at a droplet deposition rate of 100% onto the recording medium, under the above-described droplet deposition conditions.

As Table 1 reveals, when the transparent UV ink deposition volume (film thickness of solid deposition) is set to 2.5 μm, 5.0 μm or 7.5 μm by altering the number of droplet depositions of the transparent UV ink to 1 (liquid droplet volume of 1.5 pl), 2 (liquid droplet volume of 3.0 pl) or 3 (liquid droplet volume of 4.5 pl), then it is possible to form: a region with no varnishing (unvarnished portion), a matte region (matte varnish portion) or a gloss region (gloss varnish portion). The gloss level becomes greater sequentially from the "unvarnished portion", to the "matte varnish portion", to the "gloss varnish portion".

As Table 2 reveals, when the transparent UV ink deposition volume (film thickness of solid deposition) is set to 2.0 μm, 3.9 μm, . . . , or 11.7 μm by altering the number of droplet depositions of the transparent UV ink to 1 (liquid droplet volume of 3.5 pl), 2 (liquid droplet volume of 7.0 pl), . . . , or 6 (liquid droplet volume of 21.0 pl), then it is possible to form, a region with no varnishing (unvarnished portion), a region with varnished finish 1, . . . , or a region with varnished finish 5. The gloss level becomes greater sequentially from the "unvarnished portion", to the "region with varnished finish 1", . . . , to the "region with varnished finish 5".

In the examples shown in Tables 1 and 2, the droplet ejection volume of the transparent UV ink (the ejection volume per ejection action) is kept uniform and only the number of droplet depositions is changed; however, it is also possible to keep the number of droplet depositions of the transparent UV ink uniform and change the droplet ejection volume. Furthermore, it is also possible to change both the number of droplet depositions and the droplet ejection volume. In either of these cases, it is possible to control the deposition volume (film thickness) of the transparent UV ink, and hence similar beneficial effects can be obtained.

When a varnished region and an unvarnished region are to be formed in a mixed fashion on the recording medium 10, then the liquid droplet volume of the transparent UV ink (droplet ejection volume×number of droplet depositions)

relating to the varnished region should be set to $m_1$ and the liquid droplet volume of the transparent UV ink (droplet ejection volume×number of droplet depositions) relating to the unvarnished region should be set to $m_2$ ($<m_1$). For example, if the droplet ejection volume of the transparent UV ink is uniform, the number of droplet depositions of the transparent UV ink is controlled for each region, in such a manner that the number of droplet depositions of the transparent UV ink is $n_1$ in relation to the varnished region and the number of droplet depositions of the transparent UV ink is $n_2$ ($<n_1$) in relation to the unvarnished region. Consequently, it is possible to achieve a desired gloss level.

It is also possible to change the gloss levels of the image partially, by changing the liquid droplet volume (droplet ejection volume×number of droplet depositions) or the droplet deposition resolution in the varnished region. For example, if the number of droplet depositions is controlled while keeping the droplet ejection volume of the transparent UV ink uniform, then the number of droplet depositions for the portion that is to be varnished to a matte finish should be controlled to $s_1$ and the number of droplet depositions for the portion that is to be varnished to a gloss finish should be controlled to $s_2$ ($>s_1$). Furthermore, if the droplet deposition resolution of the transparent UV ink is controlled, then the droplet deposition resolution for the portion that is to be varnished to a matte finish should be set to $x_1 \times y_1$ (dpi), and the droplet deposition resolution for the portion that is varnished to a gloss finish should be set to $x_2 \times y_2$ (dpi) ($x_2>x_1$, $y_2>y_1$).

In the case of the unvarnished region, similarly to the case of the varnished region, it is possible to change the gloss levels of the image partially by altering the liquid droplet volume (droplet ejection volume×number of droplet depositions) or the droplet deposition resolution in the unvarnished region partially.

From the viewpoint of achieving an image that ensures image strength as well as achieving an image having a gloss level that is not appreciably different from offset printing, the deposition volume of the transparent UV ink onto the unvarnished region is not more than 5 μm, desirably not more than 3 μm, and more desirably not less than 1 μm and not more than 3 μm.

A desirable mode is one in which treatment liquid is deposited onto the varnished region. The wetting properties of the transparent UV ink differ between the image portion (the region where droplets of colored ink are deposited) and the non-image portion (the region where no droplets of colored ink are deposited), and therefore the gloss levels may differ undesirably between the image portion and the non-image portion. By depositing droplets of the treatment liquid onto the varnished region before depositing droplets of the transparent UV ink, it is possible to obtain an even gloss level by keeping uniform wetting properties on the surface where the droplets of the transparent UV ink are deposited. For the treatment liquid, it is possible to use a wetting property control agent (for example, an ink-aggregating acid solution), a permeation suppression agent (for example, a resin latex solution), or the like. There are no particular restrictions on the method of depositing the treatment liquid, and for example, it is possible to employ an inkjet method or an application method, or the like.

A desirable mode is one where a cationic monomer is used as the monomer of the transparent UV ink. In a case where a radical monomer is used as the monomer of the transparent UV ink, if the monomer permeates into a recording medium having permeable properties, then even if the UV light is irradiated, the monomer will remain in an uncured state inside the recording medium, and therefore it is necessary to shorten the UV light irradiation timing or to raising the irradiation intensity of the UV light. On the other hand, in a case where the cationic monomer is used as the monomer of the transparent UV ink, if the polymerization reaction starts due to the irradiation of UV light, then polymerization proceeds even if UV light is not irradiated thereafter. For this reason, it is possible to lengthen the UV light irradiation timing or to lower the UV light irradiation intensity, in comparison with the case where the radical monomer is used, and therefore the transparent UV ink can be cured more efficiently. Furthermore, the cationic monomer has a further merit in that it is highly stable when in an uncured state.

Figure 6B:
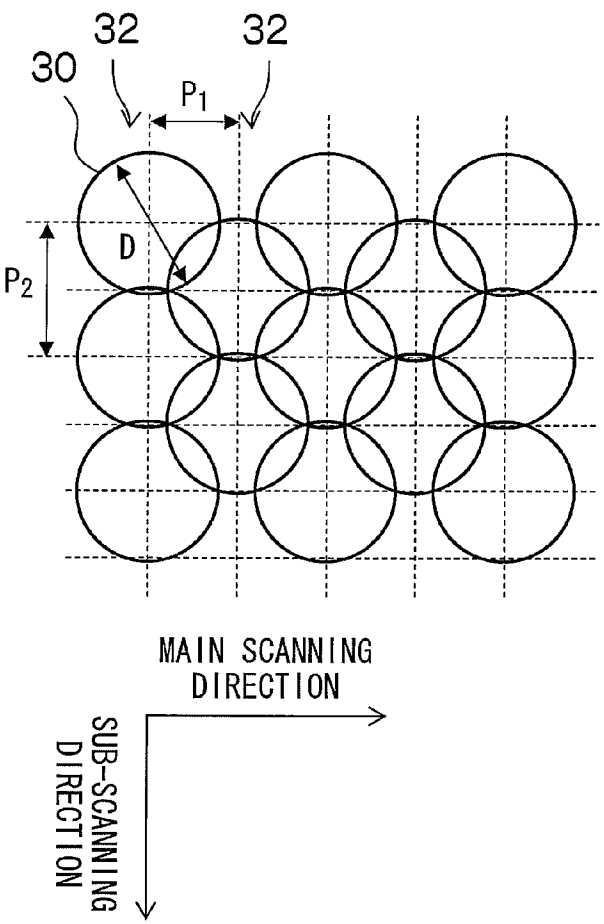
FIGS. 6A and 6B are diagrams showing arrangements of dots of transparent UV ink.
Figure 6A:
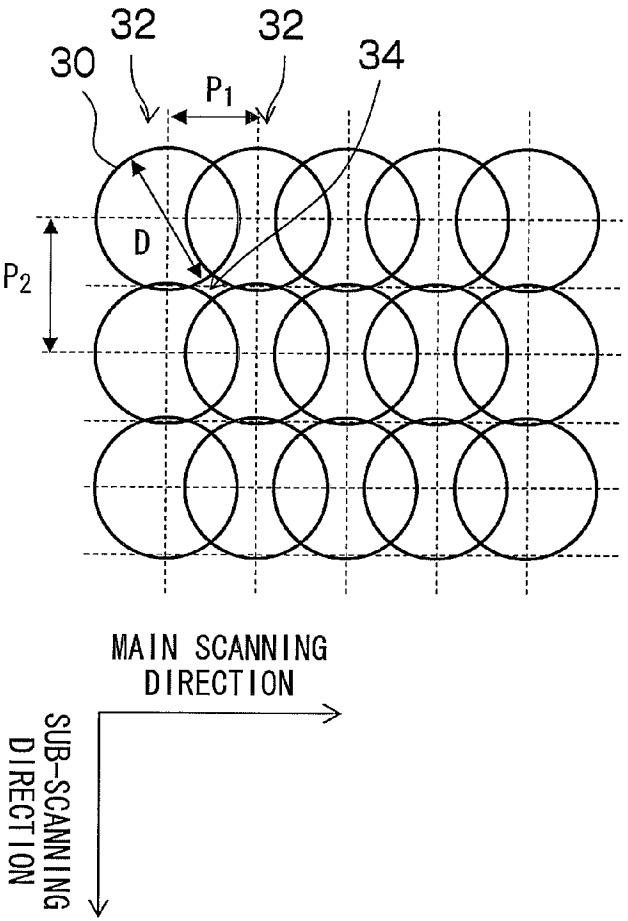

FIGS. 6A and 6B are diagrams showing the state of arrangement of the dots formed by the transparent UV ink. Each of FIGS. 6A and 6B, and FIGS. 7A and 7B described hereinafter, shows a case where droplets of the transparent UV ink are deposited at a droplet deposition rate of 100% as in a case where a solid image is formed on the recording medium; however, the droplet deposition is of course not limited to this example. FIG. 6A shows a so-called square lattice-shaped dot arrangement in which dots 30 formed by the transparent UV ink are arranged equidistantly at uniform dot pitches of $P_1$ and $P_2$, respectively, in the main scanning direction (the direction perpendicular to the conveyance direction of the recording medium) and the sub-scanning direction (the conveyance direction of the recording medium). On the other hand, FIG. 6B shows a so-called staggered matrix dot arrangement in which, if the dot rows arranged in the sub-scanning direction in FIG. 6A are denoted with reference numeral 32, then of the dot rows 32 that are mutually adjacent in the main scanning direction, one dot row is shifted by half a phase with respect to the other (in other words, the position is shifted in the sub-scanning direction by ½ of the dot pitch $P_2$ in the sub-scanning direction ($=P_2/2$)). In FIGS. 6A and 6B, the dot pitch $P_1$ in the main scanning direction is 28.2 μm, the dot pitch $P_2$ in the sub-scanning direction is 42.4 μm, and the dot diameter D of the dots 30 is 45 μm.

As shown in FIG. 6A, in the case where the droplets are deposited to form the dots 30 of the transparent UV ink in the square lattice configuration, if the spreading rate of the transparent UV ink is small and the dot diameter D of the dots 30 is small, then gaps occur between the dots as in the position indicated by reference numeral 34, and hence there may be cases where the transparent UV ink cannot be made uniform.

On the other hand, if the droplets are deposited to form the dots 30 of the transparent UV ink in the form of the staggered matrix, then even if the dot diameter D of the dots 30 (in other words, the spreading rate of the transparent UV ink) is the same as in FIG. 6A, no gaps occur between the dots. More specifically, depositing the droplets to form the dots in the form of the staggered matrix is less liable to give rise to gaps between the dots compared to a case where the droplets are deposited to form the dots in the square lattice configuration, and hence is the dot arrangement that is more suited to making the transparent UV ink uniform.

Consequently, in the present embodiment, the desirable mode is one in which the droplets of the transparent UV ink are deposited in the form of the staggered matrix onto the recording medium. More specifically, by suitably altering the nozzle arrangement or droplet ejection timing of the inkjet head that ejects the droplets of the transparent UV ink, it is possible to achieve the staggered matrix dot arrangement. Consequently, it is possible to make the transparent UV ink uniform.

Figure 7B:
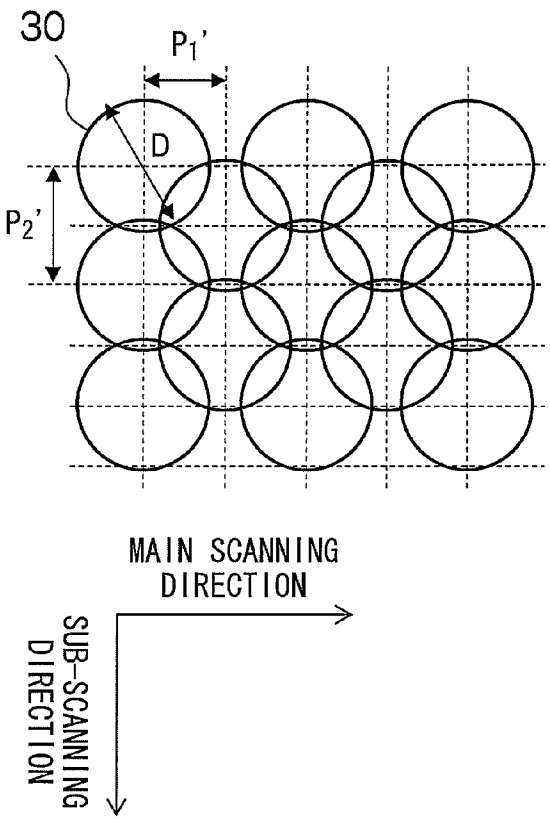
FIGS. 7A and 7B are diagrams showing arrangements of dots of transparent UV ink.
Figure 7A:
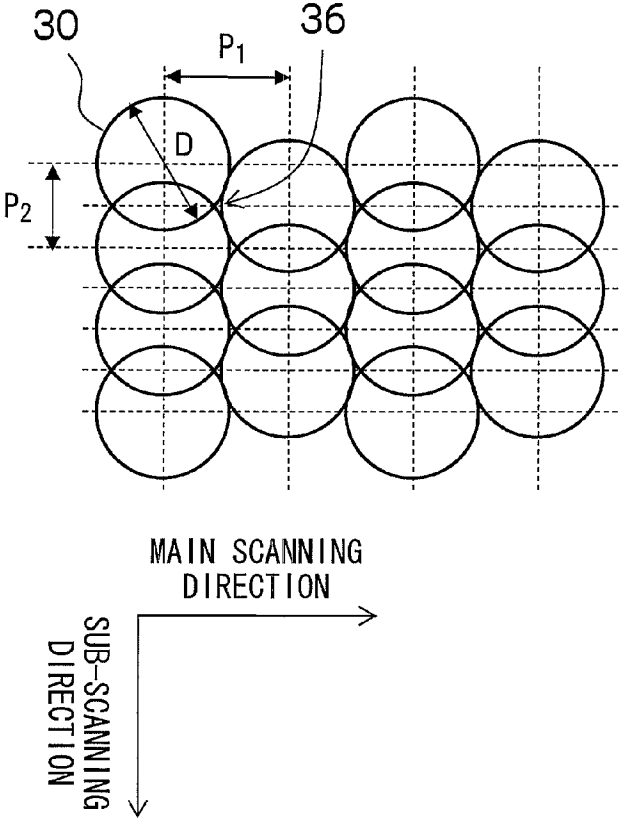

FIGS. 7A and 7B are diagrams showing staggered matrix dot arrangements. FIG. 7A shows a case where the dot pitch $P_1$ in the main scanning direction is greater than the dot pitch $P_2$ in the sub-scanning direction (in other words, $P_1>P_2$). On the other hand, FIG. 7B shows a case where the dot pitch $P_1'$ in the main scanning direction is smaller than the dot pitch $P_2'$ in the sub-scanning direction (in other words, $P_1'<P_2'$). FIGS. 7A and 7B show the cases where the dot pitch in the main scanning direction and the dot pitch in the sub-scanning direction are switched with each other (in other words, $P_1=P_2'$ and $P_2=P_1'$). More specifically, the dot pitch $P_1$ in the main scanning direction shown in FIG. 7A and the dot pitch $P_2'$ in the sub-scanning direction shown in FIG. 7B are 42.4 μm, and the dot pitch $P_2$ in the sub-scanning direction shown in FIG. 7A and the dot pitch $P_1'$ in the main scanning direction shown in FIG. 7B are 28.2 μm. Furthermore, the dot diameter D of the dots 30 shown in FIGS. 7A and 7B is 45 μm in both cases.

In the cases where the droplets are deposited to form the dots 30 of the transparent UV ink in the staggered matrix arrangements, if the dot pitch $P_1$ in the main scanning direction is greater than the dot pitch $P_2$ in the sub-scanning direction (in other words, if $P_1>P_2$), then gaps occur between the dots as in the position indicated by reference numeral 36, and hence there are cases where the transparent UV ink cannot be made uniform.

On the other hand, as shown in FIG. 7B, if the dot pitch $P_1'$ in the main scanning direction is smaller than the dot pitch $P_2'$ in the sub-scanning direction (in other words, $P_1'<P_2'$), even if the dot diameter D of the dot 30 (in other words, the spreading rate of the transparent UV ink) is the same as in FIG. 7A, no gaps occur between the dots. In other words, in the case where the droplets are deposited to form the dots 30 of the transparent UV ink in the form of the staggered matrix, then depositing the droplets in such a manner that the dot pitch in the sub-scanning direction is greater than the dot pitch in the main scanning direction achieves the dot arrangement that is not liable to produce gaps between the dots and that is hence suited to making the transparent UV ink uniform.

Consequently, in the present embodiment, if the droplets of the transparent UV ink are deposited in the staggered matrix arrangements on the recording medium, then the desirable mode is one in which the droplets are deposited in such a manner that the dot pitch in the sub-scanning direction is greater then the dot pitch in the main scanning direction. Thus, it is possible to make the transparent UV ink uniform.

As a further embodiment, it is possible to control only the droplet deposition conditions of the transparent UV ink (the droplet ejection volume, the number of droplet depositions and the droplet deposition density), in accordance with the gloss conditions of the image (print conditions). In this case also, similarly to the above-described embodiments, it is possible to achieve images having different gloss levels.

Composition of Image Forming Apparatus

Figure 8:
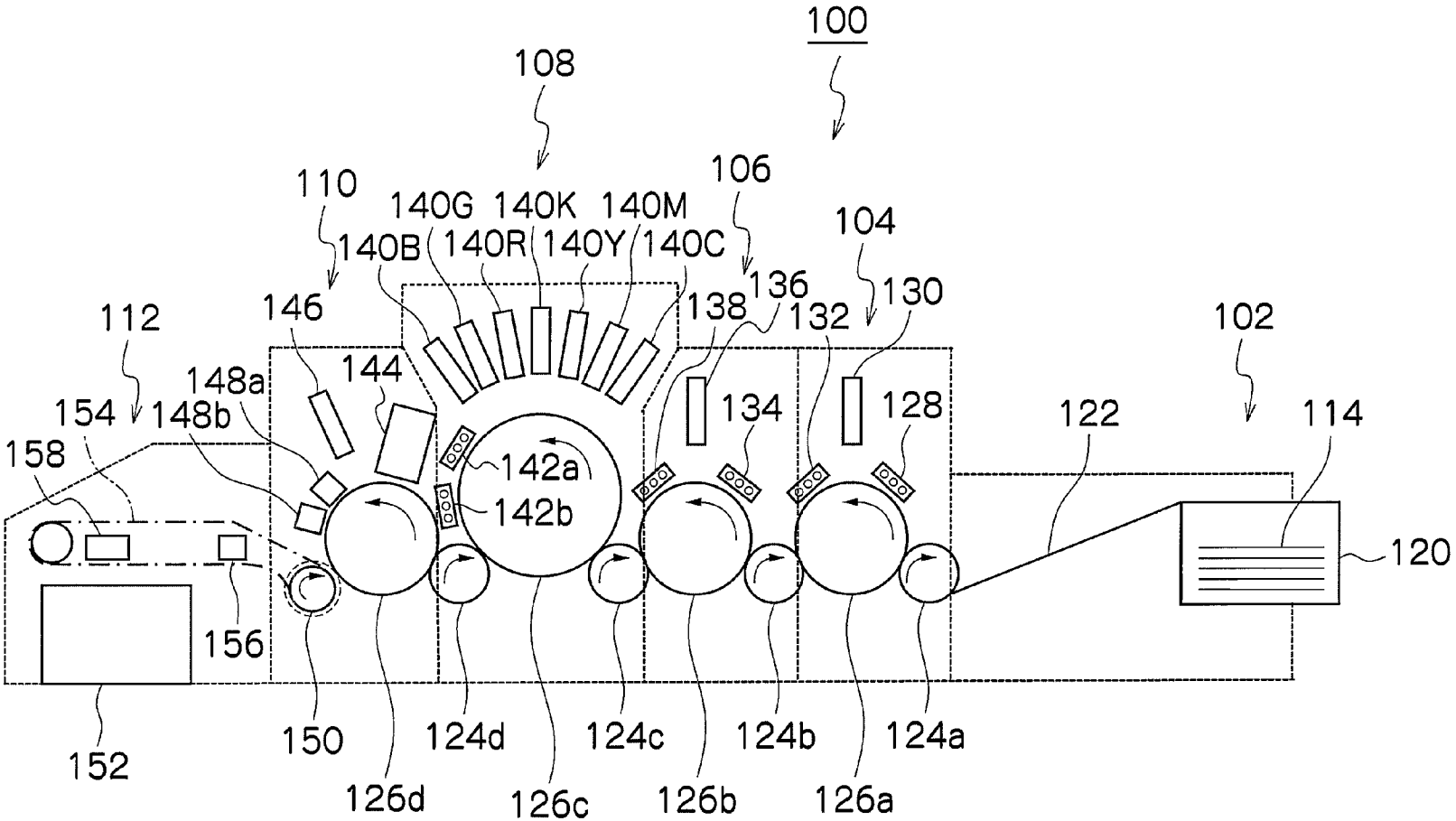
FIG. 8 is a general schematic drawing showing an image forming apparatus according to an embodiment of the present invention.

FIG. 8 is a general schematic drawing showing an image forming apparatus according to an embodiment of the present invention.

The image forming apparatus 100 shown in FIG. 8 is a single side machine, which is capable of printing only onto one surface of a recording medium 114. The image forming apparatus 100 includes: a paper supply unit 102, which supplies the recording medium 114; a permeation suppression processing unit 104, which carries out permeation suppression processing on the recording medium 114; a treatment agent deposition unit 106, which deposits treatment agent onto the recording medium 114; a print unit (image forming unit) 108, which forms an image by depositing the colored inks onto the recording medium 114; a transparent UV ink deposition unit 110, which deposits the transparent UV ink onto the recording medium 114; and a paper output unit 112, which conveys and outputs the recording medium 114 on which the image has been formed.

A paper supply platform 120 on which the recording media 114 are stacked is provided in the paper supply unit 102. A feeder board 122 is connected to the front (the left-hand side in FIG. 8) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is supplied through a transfer drum 124*a* to the surface (circumferential surface) of a pressure drum 126*a* of the permeation suppression processing unit 104.

The permeation suppression processing unit 104 is provided with a paper preheating unit 128, a permeation suppressing agent head 130 and a permeation suppressing agent drying unit 132 at positions opposing the surface of the pressure drum 126*a*, in this order from the upstream side in terms of the direction of rotation of the pressure drum 126*a* (the counter-clockwise direction in FIG. 8).

The paper preheating unit 128 and the permeation suppression agent drying unit 132 have heaters that can be temperature-controlled within prescribed ranges, respectively. When the recording medium 114 held on the pressure drum 126*a* passes through the positions opposing the paper preheating unit 128 and the permeation suppression agent drying unit 132, it is heated by the heaters of these units.

The permeation suppression agent head 130 ejects droplets of a permeation suppression agent onto the recording medium 114 that is held on the pressure drum 126*a*. The permeation suppression agent head 130 adopts the same composition as ink heads 140C, 140M, 140Y, 140K, 140R, 140G and 140B of the print unit 108, which is described below.

In the present embodiment, the inkjet head is used as the device for carrying out the permeation suppression processing on the surface of the recording medium 114; however, there are no particular restrictions on the device that carries out the permeation suppression processing. For example, it is also possible to use various other methods, such as a spray method, application method, or the like.

In the present embodiment, it is preferable to use a thermoplastic resin latex solution as the permeation suppression agent. Of course, the permeation suppression agent is not limited to being the thermoplastic resin latex solution, and for example, it is also possible to use lamina particles (e.g., mica), or a liquid rappelling agent (a fluoro-coating agent), or the like.

The treatment liquid deposition unit 106 is arranged after the permeation suppression processing unit 104. A transfer drum 124*b* is arranged between the pressure drum 126*a* of the permeation suppression processing unit 104 and a pressure drum 126*b* of the treatment liquid deposition unit 106, so as to make contact with same. Hence, after the recording medium 114 held on the pressure drum 126*a* of the permeation suppression processing unit 104 has been subjected to the permeation suppression processing, the recording medium 114 is transferred through the transfer drum 124*b* to the pressure drum 126*b* of the treatment liquid deposition unit 106.

The treatment liquid deposition unit 106 is provided with a paper preheating unit 134, a treatment liquid head 136 and a treatment liquid drying unit 138 at positions opposing the surface of the pressure drum 126*b*, in this order from the upstream side in terms of the direction of rotation of the pressure drum 126*b* (the counter-clockwise direction in FIG. 8).

The respective units of the treatment liquid deposition unit 106 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the above-described permeation suppression processing unit 104, and detailed descriptions are omitted here. Of course, it is also possible to employ different compositions to the permeation suppression processing unit 104.

The treatment liquid used in the present embodiment is an acidic liquid that has the action of aggregating the coloring materials contained in the inks that are ejected onto the recording medium 114 respectively from the ink heads 140C, 140M, 140Y, 140K, 140R, 140G and 140B disposed in the print unit 108, which is arranged at a downstream stage.

The heating temperature of a heater of the treatment liquid drying unit 138 is set to a temperature that is suitable to dry the treatment liquid having been deposited on the surface of the recording medium 114 by the ejection operation of the treatment liquid head 136 arranged to the upstream side in terms of the direction of rotation of the pressure drum 126*b*, and thereby a solid or semi-solid aggregating treatment agent layer (a thin film layer of dried treatment liquid) is formed on the recording medium 114.

The "solid or semi-solid aggregating treatment agent layer" includes a layer having a liquid content rate of 0% to 70%, where the liquid content rate is defined as: "Liquid content rate"="Weight of water contained in treatment liquid after drying, per unit surface area ($g/m^2$)"/"Weight of treatment liquid after drying, per unit surface area ($g/m^2$)".

A desirable mode is one in which the recording medium 114 is preheated by the heater of the paper preheating unit 134, before depositing the treatment liquid on the recording medium 114, as in the present embodiment. In this case, it is possible to restrict the heating energy required to dry the treatment liquid to a low level, and therefore energy savings can be made.

The print unit 108 is arranged after the treatment liquid deposition unit 106. A transfer drum 124*c* is arranged between the pressure drum 126*b* of the treatment liquid deposition unit 106 and a pressure drum 126*c* of the print unit 108, so as to make contact with same. Hence, after the treatment liquid is deposited and the solid or semi-solid aggregating treatment agent layer is formed on the recording medium 114 that is held on the pressure drum 126*b* of the treatment liquid deposition unit 106, the recording medium 114 is transferred through the transfer drum 124*c* to the pressure drum 126*c* of the print unit 108.

The print unit 108 is provided with the ink heads 140C, 140M, 140Y, 140K, 140R, 140G and 140B, which correspond respectively to the seven colors of ink, C, M, Y, K, R, G and B, and solvent drying units 142*a* and 142*b* at positions opposing the surface of the pressure drum 126*c*, in this order from the upstream side in terms of the direction of rotation of the pressure drum 126*c* (the counter-clockwise direction in FIG. 8).

The ink heads 140C, 140M, 140Y, 140K, 140R, 140G and 104B employ the inkjet type recording heads (inkjet heads), similarly to the permeation suppression agent head 130 and the treatment liquid head 136. The ink heads 140C, 140M, 140Y, 140K, 140R, 140G and 140B respectively eject droplets of corresponding colored inks onto the recording medium 114 held on the pressure drum 126*c*.

Each of the ink heads 140C, 140M, 140Y, 140K, 140R, 140G and 140B is a full-line head having a length corresponding to the maximum width of the image forming region of the recording medium 114 held on the pressure drum 126*c*, and having a plurality of nozzles 161 (not shown in FIG. 8 and shown in FIGS. 9A to 9C) for ejecting the ink, which are arranged on the ink ejection surface of the head through the full width of the image forming region. The ink heads 140C, 140M, 140Y, 140K, 140R, 140G and 140B are arranged so as to extend in a direction that is perpendicular to the direction of rotation of the pressure drum 126*c* (the conveyance direction of the recording medium 114).

According to the composition in which the full line heads having the nozzle rows covering the full width of the image forming region of the recording medium 114 are provided respectively for the colors of ink, it is possible to record a primary image on the image forming region of the recording medium 114 by performing just one operation of moving the recording medium 114 and the ink heads 140C, 140M, 140Y, 140K, 140R, 140G and 140B relatively with respect to each other (in other words, by one sub-scanning action). Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the recording medium 114, and hence it is possible to improve the print productivity.

Moreover, although the configuration with the seven colors of C, M, Y, K, R, G and B is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added. Furthermore, there is no particular restriction on the arrangement sequence of the heads of the respective colors.

Each of the solvent drying units 142*a* and 142*b* has a composition including a heater of which temperature can be controlled within a prescribed range, similarly to the paper preheating units 128 and 134, the permeation suppression agent drying unit 132, and the treatment liquid drying unit 138, which have been described above. As described hereinafter, when ink droplets are deposited onto the solid or semi-solid aggregating treatment agent layer, which has been formed on the recording medium 114, an ink aggregate (coloring material aggregate) is formed on the recording medium 114, and furthermore, the ink solvent that has separated from the coloring material spreads, so that a liquid layer containing dissolved aggregating treatment agent is formed. The solvent component (liquid component) left on the recording medium 114 in this way is a cause of curling of the recording medium 114 and also leads to deterioration of the image. Therefore, in the present embodiment, after depositing the droplets of the colored inks from the ink heads 140C, 140M, 140Y, 140K, 140R, 140G and 140B onto the recording medium 114, heating is carried out by the heaters of the solvent drying units 142*a* and 142*b*, and the solvent component is evaporated off and the recording medium 114 is dried.

The transparent UV ink deposition unit 110 is arranged after the print unit 108. A transfer drum 124*d* is arranged between the pressure drum 126*c* of the print unit 108 and a pressure drum 126*d* of the transparent UV ink deposition unit 110, so as to make contact with same. Hence, after the colored inks are deposited on the recording medium 114 that is held on the pressure drum 126*c* of the print unit 108, the recording medium 114 is transferred through the transfer drum 124*d* to the pressure drum 126*d* of the transparent UV ink deposition unit 110.

The transparent UV ink deposition unit 110 is provided with a print determination unit 144, which reads in the print results of the print unit 108, a transparent UV ink head 146, and first UV light lamps 148*a* and 148*b* at positions opposing the surface of the pressure drum 126*d*, in this order from the upstream side in terms of the direction of rotation of the pressure drum 126*d* (the counter-clockwise direction in FIG. 8).

The print determination unit 144 includes an image sensor (a line sensor, or the like), which captures an image of the print result of the print unit 108 (the droplet ejection results of the ink heads 140C, 140M, 140Y, 140K, 140R, 140G and 140B), and functions as a device for checking for nozzle blockages and other ejection defects, on the basis of the droplet ejection image captured through the image sensor.

The transparent UV ink head 146 employs the same composition as the ink heads 140C, 140M, 140Y, 140K, 140R, 140G and 140B of the print unit 108, and ejects droplets of the transparent UV ink so as to deposit the droplets of the transparent UV ink over the droplets of colored inks having been deposited on the recording medium 114 by the ink heads 140C, 140M, 140Y, 140K, 140R, 140G and 140B. Of course, it may also employ a composition different than the ink heads 140C, 140M, 140Y, 140K, 140R, 140G and 140B of the print unit 108.

The first UV lamps 148*a* and 148*b* cure the transparent UV ink by irradiating UV light onto the transparent UV ink on the recording medium 114 when the recording medium 114 passes the positions opposing the first UV lamps 148*a* and 148*b* after the droplets of the transparent UV ink have been deposited on the recording medium 114.

The paper output unit 112 is arranged after the transparent UV ink deposition unit 110. The paper output unit 112 is provided with a paper output drum 150, which receives the recording medium 114 on which the droplets of the transparent UV ink have been deposited, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

A second UV lamp 156 is arranged at the inner side of the paper output chain 154 between the sprockets. The second UV lamp 156 cures the transparent UV ink by irradiating UV light onto the transparent UV ink on the recording medium 114, by the time that the recording medium 114 having been transferred from the pressure drum 126*d* of the transparent UV ink deposition unit 110 to the paper output drum 150 is conveyed by the paper output chain 154 to the paper output platform 152.

A gloss measurement unit 158 is also arranged in the paper output unit 112. The gloss measurement unit 158 measures the degree of gloss of the surface of the recording medium 114 (the surface on which the transparent U ink has been deposited). The irradiation conditions of the UV lamps 148*a*, 148*b* and 156 (the UV light irradiation timing, irradiation intensity, and the like) and the droplet ejection conditions of the transparent UV ink head 146 (the droplet ejection volume, number of droplet depositions and droplet deposition density) are adjusted in accordance with the measured gloss obtained by the gloss measurement unit 158.

It is also possible to use a UV laser scanning device including a UV laser and a polygon mirror, instead of the UV lamps 148*a*, 148*b* and 156. In this case, it is possible to change the irradiation region and the irradiation intensity of the UV light, and it is possible to change the gloss level of the surface of the recording medium 114 partially.

Next, the structure of the ink heads 140C, 140M, 140Y, 140K, 140R, 140G and 140B disposed in the print unit 108 is described in detail. The ink heads 140C, 140M, 140Y, 140K, 140R, 140G and 140B have a common structure, and in the following description, these heads are represented by an ink head (hereinafter, simply called a "head") denoted with reference numeral 160.

Figure 9A:
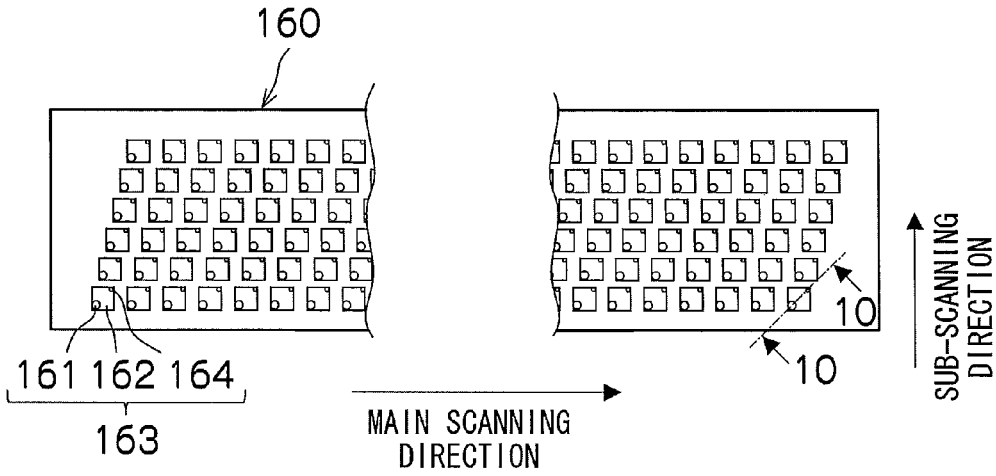
FIGS. 9A to 9C are plan view perspective diagrams showing compositions of ink heads.
Figure 9B:
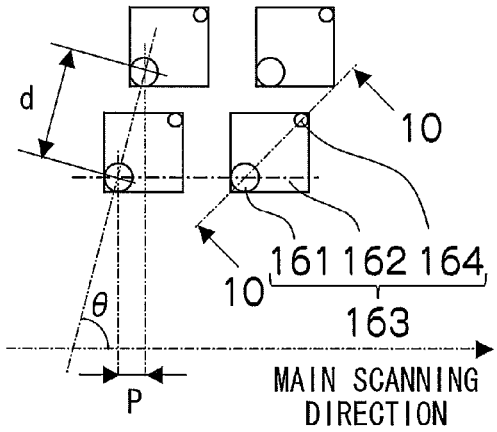
Figure 9C:
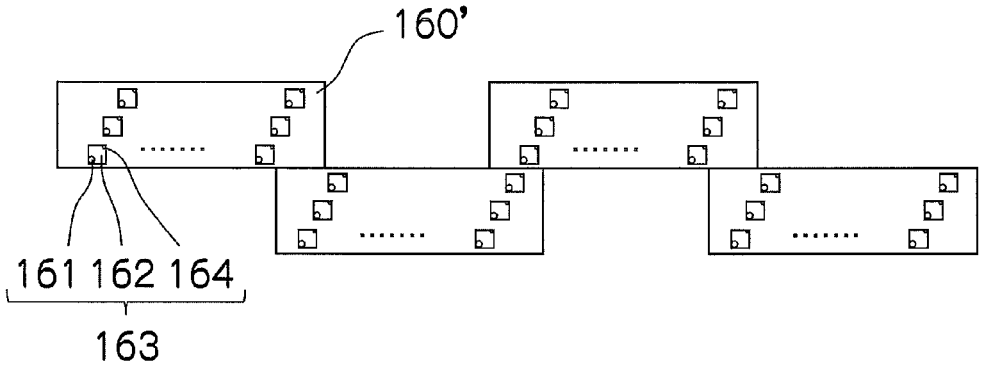
Figure 10:
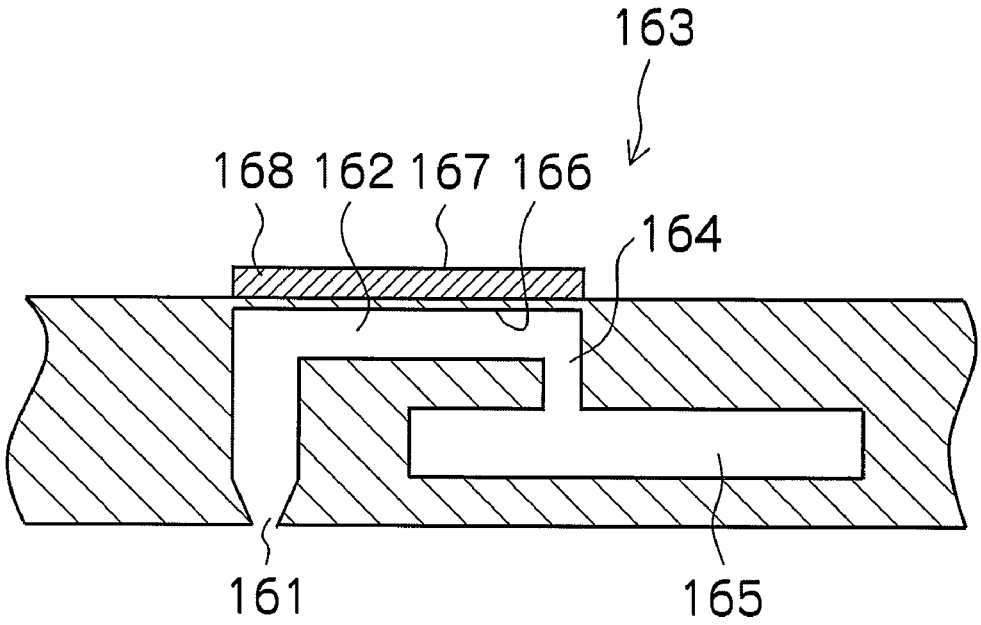
FIG. 10 is a cross-sectional diagram along line 10-10 in FIGS. 9A and 9B.

FIG. 9A is a plan view perspective diagram showing an embodiment of the structure of the head 160; FIG. 9B is an enlarged diagram showing a portion of the head; and FIG. 9C is a plan view perspective diagram showing a further embodiment of the structure of the head 160. FIG. 10 is a cross-sectional diagram along line 10-10 in FIGS. 9A and 9B, and shows the three-dimensional composition of an ink chamber unit.

The nozzle pitch in the head 160 should be minimized in order to maximize the density of the dots formed on the surface of the recording medium 114. As shown in FIGS. 9A and 9B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 9A, as shown in FIG. 9C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and the nozzle 161 and a supply port 164 are arranged respectively at corners on a diagonal of the pressure chamber 162. Each pressure chamber 162 is connected through the supply port 164 to a common flow channel 165. The common flow channel 165 is connected to an ink supply tank (not shown), which is a base tank that supplies ink, and the ink supplied from the ink supply tank is delivered through the common flow channel 165 to the pressure chambers 162.

A piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 9B, the high-density nozzle head according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is d×cos θ, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

FIG. 11 is a principal block diagram showing the system configuration of the image forming apparatus 100. The image forming apparatus 100 includes a communication interface 170, a system controller 172, a memory 174, a motor driver 176, a heater driver 178, a print controller 180, an image buffer memory 182, a head driver 184, and the like.

The communication interface 170 is an interface unit for receiving image data sent from a host computer 186. A serial interface such as USB (Universal Serial Bus), IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the image forming apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the image forming apparatus 100 in accordance with a prescribed program, as well as a calculation device for performing various calculations. More specifically, the system controller 172 controls the various sections, such as the communication interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 172. In FIG. 11, the plurality of motors (actuators) disposed in the respective sections of the image forming apparatus 100 are represented by the reference numeral 188. For example, the motor 188 shown in FIG. 11 includes the motors that drive the pressure drums 126*a* to 126*d*, the transfer drums 124*a* to 124*d* and the paper output drum 150, shown in FIG. 8.

The heater driver 178 is a driver that drives the heater 189 in accordance with instructions from the system controller 172. In FIG. 11, the plurality of heaters disposed in the image forming apparatus 100 are represented by the reference numeral 189. For example, the heater 189 shown in FIG. 11 includes the heaters of the paper preheating units 128 and 134, the permeation suppression agent drying unit 132, the treatment liquid drying unit 138, the solvent drying units 142*a* and 142*b*, and the like, shown in FIG. 8.

A gloss condition setting unit 173 functions as a gloss condition setting device that sets the gloss conditions of the image in accordance with instructions entered by the user. The gloss conditions set by the gloss condition setting unit 173 are reported to the system controller 172. For example, it is also possible to store a plurality of gloss conditions in a prescribed memory (for example, the memory 174) in such a manner that the user can select desired gloss conditions from these gloss conditions. Moreover, it is desirable that the gloss conditions should be settable respectively for regions. A UV light control unit 179 and a transparent UV ink droplet deposition control unit 180*a* are controlled through the system controller 172 in accordance with the gloss conditions set by the gloss condition setting unit 173.

The UV light irradiation control unit 179 is a control unit that controls the irradiation timing, irradiation intensity, and other irradiation conditions (irradiation time, irradiation interval, and the like) of the UV light that is irradiated from the UV light irradiation device 191. In FIG. 11, the plurality of UV light irradiation devices disposed in the image forming apparatus 100 are represented by the reference numeral 191. For example, the UV light irradiation device 191 shown in FIG. 11 includes the first UV lamps 148*a* and 148*b* and the second UV lamp 156 shown in FIG. 8. The optimal irradiation timing, irradiation intensity, and other irradiation conditions (irradiation time, irradiation interval, and the like), of the UV lamps 148*a*, 148*b* and 156 are determined in advance for each of the image gloss conditions which can be set by the gloss condition setting unit 173, and is stored in a prescribed memory (for example, the memory 174) in the form of a data base, and when the image gloss condition is set by the gloss condition setting unit 173, the memory is read and the irradiation timing, irradiation intensity and other irradiation conditions (irradiation time, irradiation interval, and the like) of the UV lamps 148*a*, 148*b* and 156 are controlled accordingly.

As described above, the plurality of UV lamps 148*a*, 148*b* and 156 are provided in the image forming apparatus 100 according to the present embodiment. By controlling the irradiation timing and the irradiation intensity of each of the UV lamps 148*a*, 148*b* and 156, it is possible to control the gloss level (surface shape) of the image and hence images having different gloss levels can be achieved. For example, it is possible to suppress permeation of the transparent UV ink into the recording medium 114 by raising the viscosity of the transparent UV ink in the vicinity of the interface with the recording medium 114, by means of the first UV lamps 148*a* and 148*b*, while curing the transparent UV ink from the interior until the surface by means of the second UV lamp 156. Instead of (or in addition to) controlling the irradiation time, the irradiation interval and the irradiation intensity of the UV lamps 148*a*, 148*b* and 156, it is also possible to control the speed at which the recording medium 114 is conveyed, or to alter the positions of the respective UV lamps 148*a*, 148*b* and 156.

The gloss measurement unit 158 measures the gloss of the surface of the recording medium 114 (the surface on which the transparent UV ink has been deposited), and reports the corresponding results to the system controller 172. For example, it measures the gloss of a test pattern that has been formed on the recording medium 10. The system controller 172 adjusts the irradiation conditions of the UV lamps 148*a*, 148*b* and 156 (the UV light irradiation timing, irradiation intensity, and the like) and the droplet ejection conditions of the transparent UV ink head 146 (the droplet ejection volume, the number of droplet depositions, and the droplet deposition density) in accordance with the gloss that has been measured by the gloss measurement unit 158.

The print controller 180 is a control unit that has signal processing functions for carrying out processing, correction, and other treatments in order to generate a print control signal on the basis of the image data in the memory 174 in accordance with the control of the system controller 172. The print controller 180 supplies the print data (dot data) thus generated to the head driver 184. Prescribed signal processing is carried out in the print controller 180, and the ejection volume and the ejection timing of the ink droplets in the head 192 are controlled through the head driver 184 on the basis of the image data. By this means, prescribed dot size and dot positions can be achieved. In FIG. 11, the plurality of heads (inkjet heads) disposed in the image forming apparatus 100 are represented by the reference numeral 192. For example, the head 192 shown in FIG. 11 includes the permeation suppression agent head 130, the treatment liquid head 136, the ink heads 140C, 140M, 140Y, 140K, 140R, 140G and 140B, and the transparent UV ink head 146, shown in FIG. 8.

Moreover, the print controller 180 includes the transparent UV ink droplet deposition control unit 180*a*, which controls the droplet deposition conditions (droplet ejection volume, number of droplet depositions and droplet deposition density) of the transparent UV ink head 146 shown in FIG. 8. The transparent UV ink droplet deposition control unit 180*a* controls the droplet deposition conditions of the transparent UV ink head 146 in accordance with the gloss conditions set by the gloss condition setting unit 173.

The print controller 180 is provided with the image buffer memory 182, and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 192, on the basis of image data supplied from the print controller 180, and also has drive circuits which drive the piezoelectric elements 168 by applying the drive signals to the piezoelectric elements 168. A feedback control system for maintaining constant drive conditions in the head 192 may be included in the head driver 184 shown in FIG. 11.

The print determination unit 144 is a block that includes the line sensor as described above with reference to FIG. 8, reads the image printed on the recording medium 114, determines the print conditions (presence of the ejection, variation in the dot formation, and the like) by performing desired signal processing, or the like, and provides the determination results of the print conditions to the print controller 180. According to requirements, the print controller 180 makes various corrections with respect to the head 192 on the basis of information obtained from the print determination unit 144.

The operation of the image forming apparatus 100 which has this composition is described below.

The recording medium 114 is conveyed to the feeder board 122 from the paper supply platform 120 of the paper supply unit 102, and is transferred through the transfer drum 124*a* onto the pressure drum 126*a* of the permeation suppression processing unit 104. The recording medium 114 held on the pressure drum 126*a* is preheated by the paper preheating unit 128, and droplets of permeation suppression agent are ejected by the permeation suppression agent head 130. Thereupon, the recording medium 114 held on the pressure drum 126*a* is heated by the permeation suppression agent drying unit 132, and the solvent component (liquid component) of the permeation suppression agent is evaporated and the recording medium 114 is thereby dried.

The recording medium 114 that has been thus subjected to the permeation suppression processing is transferred from the pressure drum 126*a* of the permeation suppression processing unit 104 through the transfer drum 124*b* to the pressure drum 126*b* of the treatment liquid deposition unit 106. The recording medium 114 held on the pressure drum 126*b* is preheated by the paper preheating unit 134 and droplets of treatment liquid are ejected by the treatment liquid head 136. Thereupon, the recording medium 114 held on the pressure drum 126*b* is heated by the treatment liquid drying unit 138, and the solvent component (liquid component) of the treatment liquid is evaporated and the recording medium 114 is thereby dried. Thus, a solid or semi-solid aggregating treatment agent layer is formed on the recording medium 114.

The recording medium 114 on which the solid or semi-solid aggregating treatment agent layer has been formed is transferred from the pressure drum 126*b* of the treatment liquid deposition unit 106 though the transfer drum 124*c* to the pressure drum 126*c* of the print unit 108. Droplets of corresponding colored inks are ejected respectively from the ink heads 140C, 140M, 140Y, 140K, 140R, 140G and 140B, onto the recording medium 114 held on the pressure drum 126*c*, in accordance with the input image data.

When the ink droplets are deposited onto the aggregating treatment agent layer, then the contact interface between each ink droplet and the aggregating treatment agent layer has a prescribed area when the ink droplet lands, due to a balance between the kinetic energy and the surface energy. The aggregating reaction starts immediately after the ink droplets have landed on the aggregating treatment agent, and the aggregating reaction starts from the surface of each ink droplet in contact with the aggregating treatment agent layer. Since the aggregating reaction occurs only in the vicinity of the contact surface, and the coloring material in the ink aggregates while the ink droplet obtains an adhesive force in the prescribed contact interface area upon landing of the ink droplet, then movement of the coloring material is suppressed.

Even if another ink droplet is subsequently deposited adjacently to the ink droplet deposited previously, since the coloring material of the previously deposited ink has already aggregated, then the coloring material does not mix with the subsequently deposited ink, and therefore bleeding is suppressed. After the aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) that has been separated from the ink aggregate on the recording medium 114 is evaporated off and the recording medium 114 is thereby dried. Thus, curling of the recording medium 114 is prevented, and furthermore deterioration of the image quality as a result of the presence of the solvent component can be restricted.

The recording medium 114 onto which the colored inks have been deposited by the print unit 108 is transferred from the pressure drum 126*c* of the print unit 108 through the transfer drum 124*d* to the pressure drum 126*d* of the transparent UV ink deposition unit 110. The print results produced by the print unit 108 on the recording medium 114 held on the pressure drum 126*d* are read in by the print determination unit 144, whereupon droplets of the transparent UV ink are ejected from the transparent UV ink head 146 over the colored inks on the recording medium 114. In this case, the transparent UV ink droplet deposition control unit 180*a* controls the droplet deposition conditions (droplet ejection volume, number of droplet depositions and droplet deposition density) of the transparent UV ink head 146, in accordance with the gloss conditions set by the gloss condition setting unit 173.

Then, the recording medium 114 held on the pressure drum 126*d* passes the positions opposing the first UV lamps 148*a* and 148*b*, and is transferred from the pressure drum 126*d* to the paper output drum 150. The recording medium 114 passes the position opposing the second UV lamp 156 while being conveyed to the paper output platform 152 by the paper output chain 154. The recording medium 114 is then conveyed onto the paper output platform 152 by the paper output chain 154 and is stacked on the paper output platform 152.

The irradiation conditions of the UV lamps 148*a*, 148*b* and 156 (irradiation timing, irradiation intensity, and the like) are controlled by the UV irradiation control unit 179 in accordance with the gloss conditions set by the gloss condition setting unit 173. For example, if a glass portion and a matte portion are to be formed together, then after depositing droplets of the transparent UV ink onto the recording medium 114, when the recording medium 114 passes the positions opposing the first UV lamps 148*a* and 148*b*, UV light is irradiated onto the transparent UV ink by the first UV lamps 148*a* and 148*b*, and the transparent UV ink increases in viscosity at the interface with the recording medium 114, thereby suppressing permeation of the transparent UV ink into the recording medium 114. Furthermore, when the recording medium 114 subsequently passes the position opposing the second UV lamp 156, UV light is irradiated onto the transparent UV ink by the second UV lamp 156, and the transparent UV ink on the recording medium 114 is cured from the surface through to the interior. By this means, it is possible to achieve an image having a desired gloss level.

In this way, according to the image forming apparatus 100 of the present embodiment, it is possible to achieve images having different gloss levels by controlling the time (UV light irradiating timing) until UV light is irradiated after the deposition of droplets of the transparent UV ink onto the surface of the recording medium 114, and by controlling the irradiation intensity of the UV light, in accordance with the gloss conditions of the image (print conditions). Consequently, there is no need to use transparent UV inks having different wetting properties, and it is possible to output efficiently a small number of prints having different gloss levels.

Furthermore, a desirable mode is one in which the number of droplet depositions (droplet deposition volume) and the droplet deposition density of the transparent UV ink are controlled in accordance with the gloss conditions, since this makes it possible to finely change the gloss levels of the image.

Figure 12:
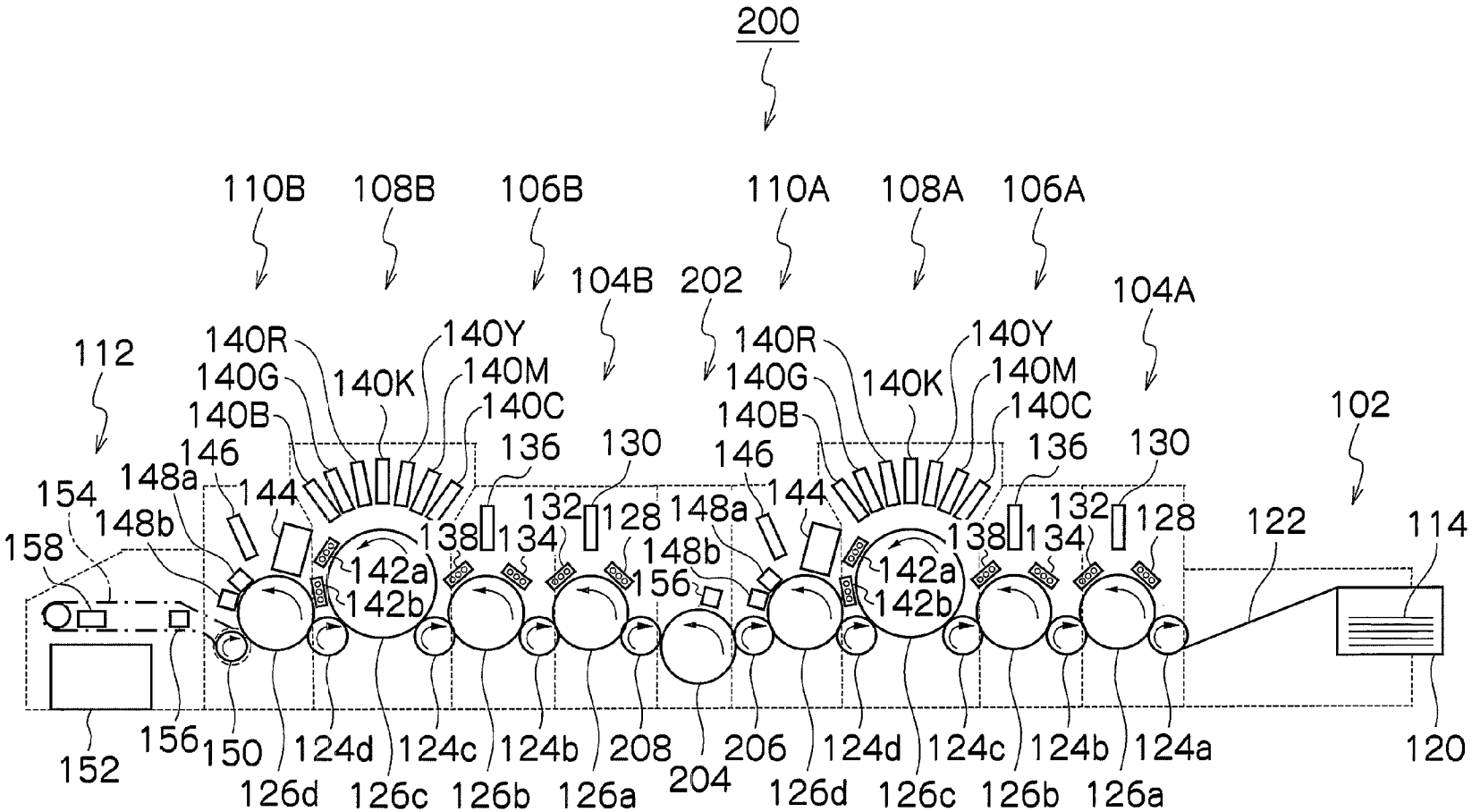
FIG. 12 is a general schematic drawing showing an image forming apparatus according to another embodiment of the present invention.

FIG. 12 is a general schematic drawing showing an image forming apparatus according to another embodiment of the present invention. In FIG. 12, members that are the same as or similar to FIG. 8 are denoted with the same reference numerals and description thereof is omitted here.

The image forming apparatus 200 shown in FIG. 12 is a double side machine, which is capable of printing onto both surfaces of a recording medium 114. The image forming apparatus 200 includes: in order from the upstream side in terms of the direction of conveyance of the recording medium 114 (the right to left direction in FIG. 12), a paper supply unit 102, a first permeation suppression processing unit 104A, a first treatment liquid deposition unit 106A, a first print unit 108A, a first transparent UV ink deposition unit 110A, a reversing unit 202, which reverses the recording surface (image forming surface) of the recording medium 114, a second permeation suppression processing unit 104B, a second treatment liquid deposition unit 106B, a second print unit 108B, a second transparent UV ink deposition unit 110B, and a paper output unit 112. The image forming apparatus 200 is thus provided with a composition including the permeation suppression processing unit 104, the treatment liquid deposition unit 106, the print unit 108 and the transparent UV ink deposition unit 110 of the image forming apparatus 100 shown in FIG. 8, on each side of the reversing unit 202.

In the image forming apparatus 200 according to the present embodiment, firstly, similarly to the image forming apparatus 100 shown in FIG. 8, permeation suppression processing and droplet deposition of the treatment liquid, the colored inks, and the transparent UV ink are carried out by the first permeation suppression processing unit 104A, the first treatment liquid deposition unit 106A, the first print unit 108A, and the first transparent UV ink deposition unit 110A successively onto one surface of the recording medium 114, which is supplied from the paper supply unit 102.

After thereby forming an image on the one surface of the recording medium 114, the recording medium 114 is reversed when it is transferred to the reversing drum 204 from the pressure drum 126*d* of the first transparent UV ink deposition unit 110A through the transfer drum 206. The reversal mechanism for the recording medium 114 employs commonly known technology and therefore a concrete description is not given here. A second UV lamp 156 is arranged at a position opposing the surface of the reversing drum 204, and this serves to cure the transparent UV ink that has been deposited on the recording medium 114, together with the first UV lamps 148*a* and 148*b* of the first transparent UV ink deposition unit 110A.

The recording medium 114 that has been reversed is transferred from the reversing drum 204 through the transfer drum 208 to the pressure drum 126*a* of the second permeation suppression processing unit 104B. Thereupon, permeation suppression processing and droplet deposition of the treatment liquid, the colored inks, and the transparent UV ink, and the like, are carried out by the second permeation suppression processing unit 104B, the second treatment liquid deposition unit 106B, the second print unit 108B and the second transparent UV ink deposition unit 110B successively onto the other surface of the recording medium 114.

After thus forming the images on both surfaces of the recording medium 114, the recording medium 114 is conveyed onto the paper output platform 152 by the paper output chain 154, and is stacked on the paper output platform 152.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an image forming device which forms an image on a recording medium;

a transparent UV ink droplet ejection device which ejects and deposits droplets of transparent UV ink onto the recording medium;

a UV light irradiation device having at least one UV light source which irradiates UV light onto the transparent UV ink having been deposited on the recording medium;

a gloss condition setting device which sets a gloss condition including a gloss level of the image; and a UV light irradiation timing control device which controls a time interval from ejection of the transparent UV ink onto the recording medium until irradiation of the UV light from the UV light irradiation device in accordance with the gloss condition in such a manner that, the higher the gloss level of the image set by the gloss condition setting device is, the longer the time interval from ejection of the transparent UV ink onto the recording medium until irradiation of the UV light.

2. The image forming apparatus as defined in claim 1, further comprising a light source movement mechanism for moving the at least one UV light source so as to adjust the time interval from ejection of the transparent UV ink onto the recording medium until irradiation of the UV light, wherein:

the UV light irradiation timing control device causes the light source movement mechanism to move the at least one UV light source in accordance with the gloss condition so as to control the time interval from ejection of the transparent UV ink onto the recording medium until irradiation of the UV light.

3. The image forming apparatus as defined in claim 1, wherein:

the UV light irradiation device includes a plurality of UV light sources fixed to positions which cause different time intervals from ejection of the transparent UV ink onto the recording medium until irradiation of the UV light from each other; and the UV light irradiation timing control device controls the time interval from ejection of the transparent UV ink onto the recording medium until irradiation of the UV light by irradiating UV light selectively from the UV light sources in accordance with the gloss condition.

4. The image forming apparatus as defined in claim 3, wherein:

a first one of the UV light sources performs preliminary curing of the transparent UV ink having been deposited on the recording medium; and a second one of the UV light sources performs main curing of the transparent UV ink having been subjected to the preliminary curing.

5. The image forming apparatus as defined in claim 1, further comprising a UV light irradiation intensity control device for adjusting irradiation intensity of the UV light from the at least one UV light source in accordance with the gloss condition in such a manner that, the higher the gloss level of the image set by the gloss condition setting device is, the lower the irradiation intensity of the UV light from the at least one UV light source is.

6. The image forming apparatus as defined in claim 1, further comprising a UV light irradiation region control device for controlling an irradiation region of the UV light irradiated from the at least one UV light source in accordance with the gloss condition.

7. The image forming apparatus as defined in claim 1, further comprising a transparent UV ink droplet deposition control device which controls a deposition volume of the transparent UV ink onto the recording medium.

8. The image forming apparatus as defined in claim 7, wherein the transparent UV ink droplet deposition control device controls the deposition volume of the transparent UV ink onto the recording medium, by controlling at least one of a number of droplet depositions, a droplet ejection volume, and a droplet deposition density, of the transparent UV ink droplet ejection device.

9. The image forming apparatus as defined in claim 7, wherein the transparent UV ink droplet deposition control device performs control in such a manner that dots of the droplets of the transparent UV ink ejected from the transparent UV ink droplet ejection device are deposited onto the recording medium in a form of a staggered matrix.

10. The image forming apparatus as defined in claim 9, wherein the transparent UV ink droplet deposition control device performs control in such a manner that a density of the dots of the deposited droplets of the transparent UV ink ejected from the transparent UV ink droplet ejection device in a direction that is perpendicular to a conveyance direction of the recording medium is greater than a density of the dots of the deposited droplets of the transparent UV ink in the conveyance direction of the recording medium.

11. The image forming apparatus as defined in claim 7, further comprising:

a gloss determination device which determines a degree of gloss on the recording medium, wherein an ejection condition of the transparent UV ink droplet ejection device is determined in accordance with the degree of gloss determined by the gloss determination device.

12. The image forming apparatus as defined in claim 1, further comprising:

a gloss determination device which determines a degree of gloss on the recording medium, wherein an irradiation condition of the at least one UV light source is determined in accordance with the degree of gloss determined by the gloss determination device.

13. The image forming apparatus as defined in claim 1, wherein the image forming device causes an inkjet head having nozzles to eject ink from the nozzles so as to form the image on the recording medium.

* * * * *